United States Patent [19]

Koerber, Sr. et al.

[11] Patent Number: 4,882,566

[45] Date of Patent: Nov. 21, 1989

[54] SAFETY CONTROL SYSTEM FOR A HOSPITAL BED

[75] Inventors: Clement J. Koerber, Sr., Batesville, Ind.; Dennis J. Gallant, Harrison, Ohio; L. Dale Foster, Brookville, Ind.

[73] Assignee: Hill-Rom Company, Inc., Batesville, Ind.

[21] Appl. No.: 227,863

[22] Filed: Aug. 3, 1988

[51] Int. Cl.[4] ..... F21V 33/00; F21V 23/04

[52] U.S. Cl. ..... 340/825.690; 340/825; 362/130; 362/801; 52/28; 5/1; 5/11

[58] Field of Search ..... 362/85, 221, 222, 147, 362/239, 253, 149, 801, 130; 5/2 R, 53 R, 11, 1, 511, 508; 269/325, 322; 312/237, 246, 247; 174/48, 49, 70 R, 101; 318/16, 468; 307/140; 52/28, 36; 340/825.3, 825.32, 825.69, 539, 501, 552, 825

[56] References Cited

U.S. PATENT DOCUMENTS

| | | | |
|---|---|---|---|
| 3,657,720 | 4/1972 | Avdenko et al. | 340/825.69 |
| 3,769,502 | 10/1973 | Schultz et al. | 362/801 |
| 3,803,396 | 4/1974 | Damico | 240/2 R |
| 3,828,185 | 8/1974 | Vandling | 250/199 |
| 3,919,540 | 11/1975 | Burst et al. | 240/2 R |
| 4,149,222 | 4/1979 | Linde | 362/130 |
| 4,150,284 | 4/1979 | Trenkler et al. | 250/199 |
| 4,151,407 | 4/1979 | McBride et al. | 250/199 |
| 4,371,814 | 2/1983 | Hannas | 318/16 |
| 4,412,355 | 10/1983 | Terbrack et al. | 455/603 |
| 4,427,890 | 1/1984 | Taumann | 250/385 |
| 4,646,211 | 2/1987 | Gallant et al. | 362/149 |
| 4,675,656 | 6/1987 | Narcisse | 340/539 |

*Primary Examiner*—Donald J. Yusko
*Assistant Examiner*—Eric Pudpud
*Attorney, Agent, or Firm*—Wood, Herron & Evans

[57] ABSTRACT

A safety control system for an electrically operated hospital bed utilizes a wireless disconnect signal from an above mounted safety light to an outlet below which supplies electrical power to the bed, thereby to interrupt power to the outlet upon the detection of physical contact with the safety light, as perhaps caused by an IV pole raising with the bed. In a preferred embodiment, a two-way transmission path is utilized to verify no blockage of the line of sight transmission path between the outlet and the light, with power to the outlet being disconnected upon contact with the light or blockage of the line of sight path.

12 Claims, 4 Drawing Sheets

SAFETY CONTROL SYSTEM FOR A HOSPITAL BED

FIELD OF THE INVENTION

This invention relates to a safety control system for an electrically operated hospital bed. More particularly, this invention relates to a safety control system which disconnects electrical power at an outlet supplying power to the bed when a bed mounted structure is elevated into contact with an overhead safety light.

BACKGROUND OF THE INVENTION

An electrical outlet supplies electrical power through a power cord to an electrically operated hospital bed to enable vertical or other movement of the bed. A typical hospital room also provides an overhead reading light, mounted to the head wall, the wall located behind the head portion of the bed. When intravenous (IV) rods or fracture frames are mounted to extend above the bed in such a manner as to move vertically with the bed, raising of the bed can cause the rod or frame to contact and damage the overhead light.

The IV pole could be moved to the side of the bed, away from under the light. However, it is preferably mounted to the head portion of the bed to be out of the way of nurses in their performance of regular procedures, and out of the way of the patient.

It is known to employ a safety control system to disconnect power to the bed upon contact between an IV pole and the head wall mounted safety light. Such a safety control system employs a safety light fixture which is equipped with a safety switch. The safety switch is in hard wire electrical communication with the outlet supplying power to the bed, and is adapted to open upon detecting contact of the safety light, thereby interrupting electrical power to and vertical movement of the bed. U.S. Pat. No. 3,919,540 in the name of Burst et al., incorporated herein by reference in its entirety, discloses a safety light which may be used for the above described safety control system. The light has some vertical play, to prevent fracture upon initial contact.

Most modern hospitals are equipped with a modular head wall unit located behind the bed. The safety light is mounted to or above the upper portion of the head wall unit. The hard wire connection between the safety light and the bed outlet can be easily routed through a modular head wall unit of this type.

In hospital rooms which do not have the modular head wall unit, in order to install a safety control system of the type described, a conduit carrying the connecting wires must be buried in the head wall between the safety light and the outlet. The cost of routing and burying the conduit between the above mounted safety light and the outlet below is considered excessive, generally requiring the services of an outside contractor to perform the installation work. Moreover, burying of the conduit in the head wall necessitates refinishing of the head wall after work has been completed, thus representing an additional expense associated with down time for the hospital room.

It is therefore an object of this invention to provide a safety control system for interrupting electrical power to a hospital bed which alleviates the need to route a head wall buried conduit between the safety light and the outlet.

It is another object of this invention to provide a safety control system which is easily installed, regardless of whether or not the hospital room is equipped with a modular head wall unit.

It is still another object of this invention to provide a safety control system which can be installed without incurring significant downtime for the hospital room.

SUMMARY OF THE INVENTION

To these ends, this invention provides a safety control system which utilizes a wireless communication between the safety light and the outlet to indicate when electrical power to the outlet should be disconnected. Use of a wireless communication alleviates the need to route a conduit carrying a hard wire connection in the head wall between the safety light and the outlet.

But a simple one way wireless communication between the safety light and the outlet presents problems. The one way signal must necessarily be transmitted to the outlet serving the bed, in order to disconnect power to the bed. If the control system is designed to be normally off, an "on" signal must be sent to the outlet from the safety light upon the detection of contact. However, if the line of sight path between the safety light and the outlet is blocked, the "on" signal cannot be received, and the bed can continue vertical movement to damage the light. On the other hand, if the control system is designed to be normally on, an "off" signal must be sent from the safety light to the outlet upon the detection of contact. If the line of sight path becomes blocked, vertical movement of the bed will be interrupted, regardless of whether or not the light was contacted. Thus, either detected contact, path blockage, or both, will stop vertical movement of the bed. Although a control system of this type would protect the light from damage, it would be inconvenient for hospital personnel. Upon entering a hospital room in which power to the bed has been interrupted, a nurse would not know which conditions caused the interruption.

These problems are solved by the preferred embodiment of this invention. A first wireless signal is transmitted from a transmitter mounted adjacent the outlet, to a receiver mounted at the safety light. The receiver is adapted to respond to the first wireless signal by energizing an indicator, i.e., a light and/or an audible alarm, mounted at the safety light. The indicator notifies hospital personnel that the line of site transmission path between the outlet and the light is clear, with no obstacles. If a one-way transmission were utilized, with an indicator, such an indicator would necessarily be located adjacent the outlet, where it would not easily be seen by hospital personnel. Thus, the first wireless signal travels from the outlet to the light.

The safety light receiver is operatively associated with a second transmitter, mounted at the safety light. Upon reception of the first wireless signal, the safety light receiver keys the second transmitter to transmit a second wireless signal back to the receiver at the outlet. Near the outlet, the second wireless signal is received, amplified and fed into a relay which controls the supply of electrical power to the outlet. Failure to receive the second wireless signal at the outlet will open the relay and disconnect power to the outlet, thereby preventing further movement of the bed. Because reception of the first wireless signal is a necessary condition to transmission of the second wireless signal, reception of the first wireless signal by the safety light receiver is a necessary condition to the supplying of electrical power to the bed.

A safety switch mounted at the safety light is operatively associated with the second transmitter. The safety switch is adapted to detect physical contact of the light. Upon detection of contact, the safety switch disables transmission of the second wireless signal, thereby disconnecting power to the outlet to stop further movement of the bed.

Thus, the occurrence of either one or two conditions will disconnect power to the bed, either the detection of contact by the safety switch, or the blockage of the line of sight transmission path resulting in failed reception of one of the wireless signals. The use of a two way transmission path, with the indicator mounted at the safety light, allows for a quick and easy determination if either of these two conditions caused the interruption of power to the bed.

The first and second wireless signals are preferably infrared signals, to minimize interference with electromagnetic waves within a hospital room. Typically, the reading light for a hospital room is a fluorescent light, which transmits wavelengths spanning the visible spectrum and extending slightly into the band of sensitivity of infrared detectors. This results in some ambient light being directed toward the outlet, making it difficult to obtain a satisfactory signal to noise ratio at the outlet.

To solve this problem, the magnitude of the wireless signals could simply by increased to a sufficient level. However, this would result in an excessive amount of electrical energy being used up. Moreover, infrared light emitting diodes, which are preferably used to transmit the wireless signals, would burn out and have to be replaced at these higher power levels.

To reduce the effects of ambient light, while at the same time reducing power consumption, the first and second wireless signals are pulsed. At the outlet, a pulsed signal of known duration can be filtered and distinguished from ambient interference. Moreover, use of a pulsed signal enables the control system to continuously provide power to the outlet, while only consuming power necessary to send and receive intermittent signals. As compared to a continuous signal, a pulsed signal requires less energy in transmitting and receiving.

To prevent the introduction of noise into the system between pulses, the pulses are synchronized. At the outlet, the control system is responsive to a second wireless pulse from the light only during the time when a first wireless pulse is transmitted.

To further reduce the effects of ambient light, the transmitters and the receivers are aimed and shielded, respectively.

Thus, this invention alleviates the need to route a conduit in the head wall of a hospital room between the safety light and the outlet, thus reducing the cost and downtime normally associated with retrofitting a safety control system for an electrically operated hospital bed. Moreover, according to a feature of this invention, use of a two-way transmission of wireless signals provides a control system which is user-friendly for hospital personnel.

These and other objects and advantages will be further appreciated from the following detailed description of a preferred embodiment and from the drawings in which:

DETAILED DESCRIPTION OF THE DRAWINGS

Figure 1:
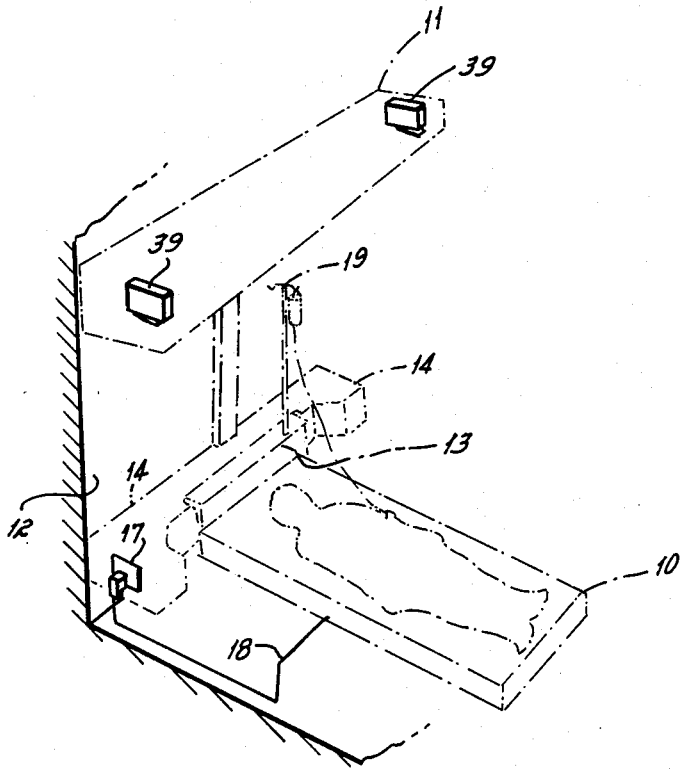
FIG. 1 is a schematic pictorial view of a safety light mounted above a hospital bed, the bed being positioned adjacent to a wall between spaced bed locaters.

FIG. 1 shows a hospital bed 10 adaptable for use by a patient in a hospital room. A safety light 11 is mounted to a head wall 12 behind a head portion 13 of the bed 10 in order to illuminate the room. The light 11 is typically a fluorescent light, for reading. Bed locators 14, or bumpers, are mounted to the head wall 12 below the light 11 to indicate the proper placement of the bed 10.

An outlet 17 adjacent the floor supplies electrical power to the electrically operated bed 10 for vertical or other movement through a power cord 18. Bed locaters 14, or two spaced bumpers, are mounted to extend horizontally from the head wall 12 to indicate the proper position of the bed. Preferably, the outlet 17 is mounted to a bumper 14 adjacent the floor of the room, relative to the light. An IV pole 19 mounted to the bed is preferably located at the headboard 13 of the bed 10 to be out of the way of nurses and the patient. Mounted to the headboard 13, the IV pole 19 will raise vertically when the bed 10 is raised.

Figure 2:
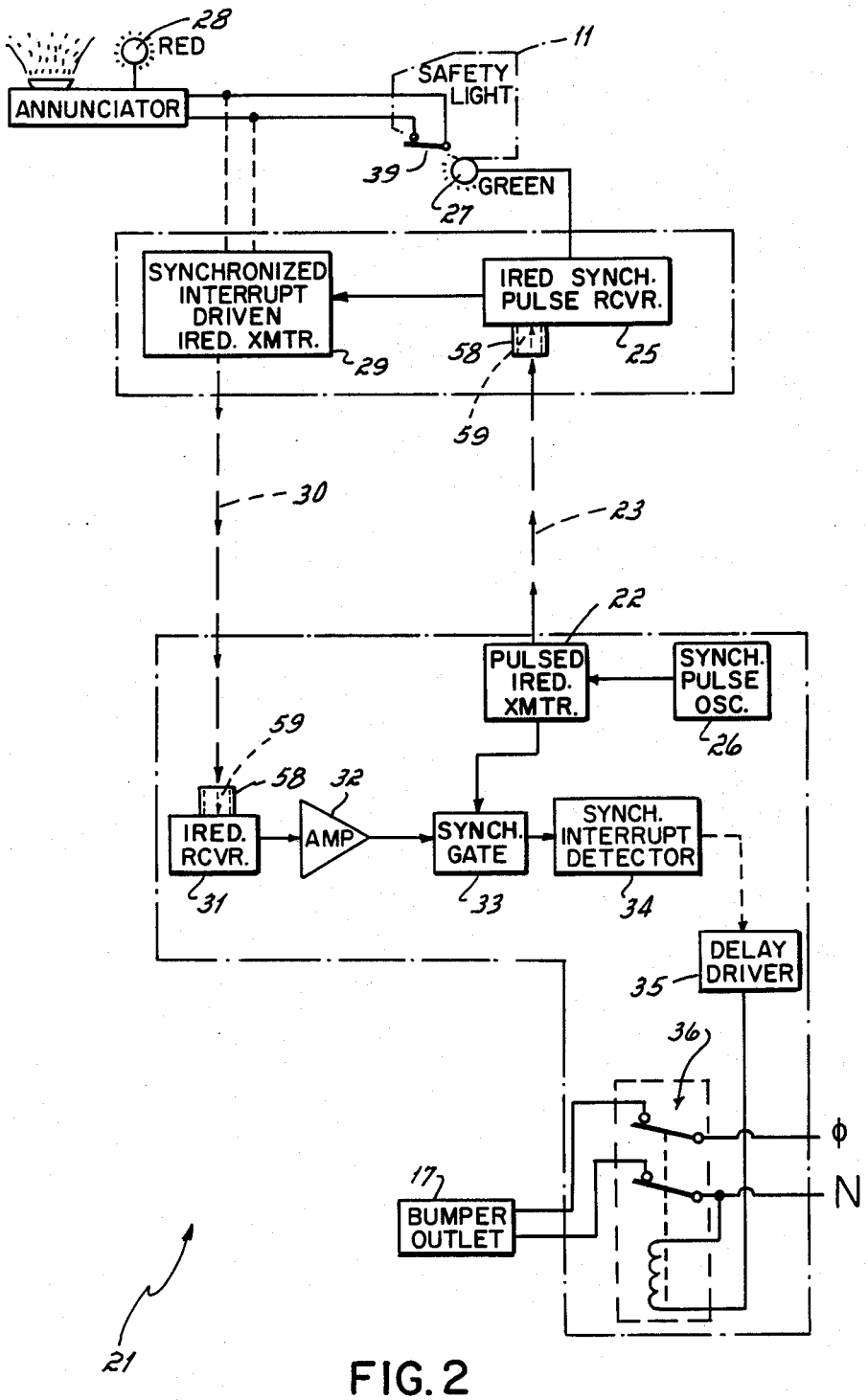
FIG. 2 is a functional schematic of a preferred embodiment of the safety control system of this invention.

A safety control system designated generally 21 utilizes a wireless signal from the light 11 to the bed 10 to disconnect power to the outlet 17 when contact with the light 11 is detected. Such contact can occur when the IV rod 19 or some other headboard 13 mounted structure raises with the bed 10. As mentioned previously, the direct approach of providing a control system with a one way wireless signal from the light 11 to the bed 10 presents problems. Therefore, the preferred embodiment of this invention utilizes a two-way transmission path. The safety control system 21 comprises an infrared transmitter 22 adjacent the outlet 17 which transmits a first pulsed infrared signal along line of sight path 23, shown in FIG. 2, to an infrared receiver 25 at the light 11. The first signal is pulsed by a synchronous pulse oscillator 26 which will be described in more detail later.

Reception of the first signal is preferably indicated by a green indicating light 27 mounted to the safety light 11. Thus, illumination of the green light 27 indicates a clear line of sight path between the outlet and the light. A red light 28 and/or an audible alarm may be used to indicate a failure to receive the first signal. This enables the nurse to readily determine, and correct if necessary, the presence of blockage in the line of sight transmission path 23.

Upon reception of the first signal, the receiver 25 keys a second infrared transmitter 29, mounted at the light 11, to transmit a second pulsed infrared signal back toward the outlet 17 along path 30.

At the outlet 17, the second signal is received by a second infrared receiver 31. The signal is amplified by a noise immune infrared amplifier 32 and fed into a synchronous gate 33 which is open to a synchronous detector 34 in coincidence with the synchronous pulse of the first signal. When pulses are present at the detector 34, a relay driver 35 holds a relay 36 supplying power to the outlet 17 in a normally closed position. Failure to receive the second pulsed signal by receiver 31 will cause relay 36 to be opened, thus disconnecting power to the outlet 17. Therefore, blockage of either transmission path, 23 or path 30, will prevent the second wireless signal from being received and disconnect electrical power to the outlet 17.

At least one safety switch 39 is mounted to the safety light 11 and adapted to detect physical contact with the light 11, as by a vertically moving IV rod 19. Upon detecting such contact, the switch 39 disables the transmission of the second wireless signal, thereby disconnecting electrical power to the outlet 17. In order to provide increased sensitivity in detecting the contact, two safety switches 39 are preferred, with the switches 39 located at opposite ends of the light 11. Preferably, the switches 39 are normally closed, and opened by contact with the light 11.

Figure 3:
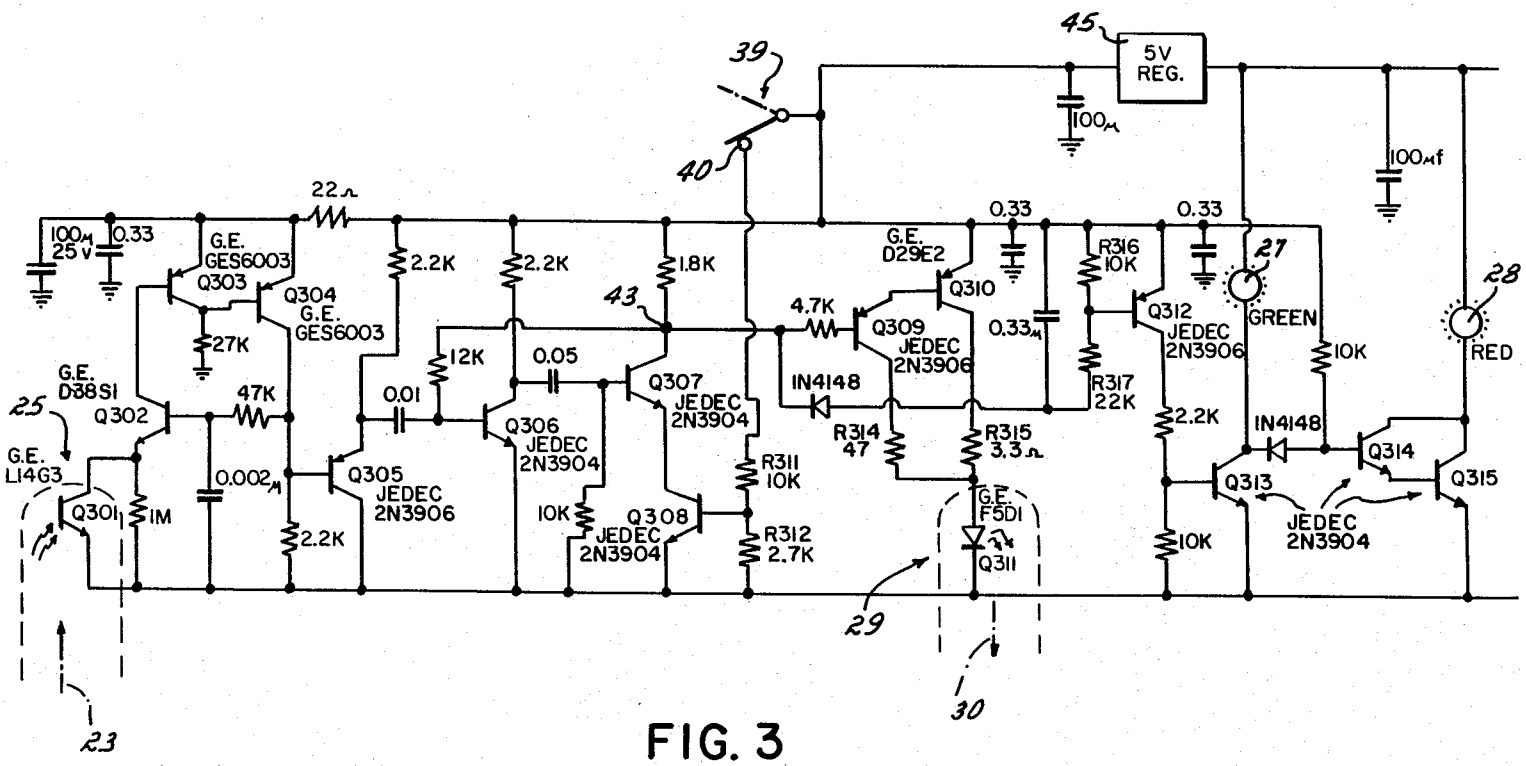
FIG. 3 is a circuit diagram of a preferred embodiment of the safety light mounted circuit of the safety control system of this invention.

FIG. 3 is a schematic showing the circuit components and interconnections for the safety light 11. When the safety switch 39 is closed, with contact at point 40, reception of the first pulsed wireless signal by the receiver 25, also shown as Q301, keys the second transmitter 29, also shown as Q311, to transmit a second pulsed wireless signal back toward outlet 17. This keying is accomplished via components Q302 through Q310 and the associated resistors and capacitors. An amplifier comprising transistors Q302 through Q304 and associated resistors and capacitors, provides noise immune infrared amplification of the signal received at Q301 (23), resulting in a signal at the output of Q304 which has unity gain with respect to ambient noise. Components Q302 through Q310 are commercially available parts with the catalog numbers shown in FIG. 3. Receiver 25 (Q301) is an infrared photosensitive transistor commercially available from General Electric under catalog No. G.E.L14G3. Second transmitter 29 (Q311) is an infrared transmitting diode sold by General Electric and commercially available under catalog No. G.E.F5D1.

Because the first wireless signal is pulsed, all references to components Q301 through Q311 as being "on" or "off" correspond respectively to increasing or decreasing quiescent current for the duration of time in which a pulse is received at Q301. When a pulse is received at Q301, it turns Q301 on, Q302 is turned on, or starts conducting at a higher current than quiescent, Q303 conducts, or is turned on, Q304 is turned off, Q305 is turned on, Q306 is turned off, turning on Q307.

Simultaneously, if the safety switch 39 is closed, current flows through resistors R311 and R312, causing Q308 to conduct. With Q307 and Q308 biased to conduct, Q307 collector current will flow to cause Q309 and Q310 to conduct. With Q309 and Q310 conducting, current flows through resistors R314 and R315 and combines to flow through Q311 (29) to transmit the pulsed signal received at Q301 (25) back toward the outlet 17 via path 30.

Either opening of the safety switch 39 or failure to receive the first wireless signal at (25) Q301 will prevent the second wireless signal from being transmitted from (29) Q311. If the safety switch 39 is opened, as shown in phantom in FIG. 3, no current flows through R311 and R312, thus turning off Q308, and interrupting Q307 collector current. With no Q307 collector current, Q309 and Q310 are turned off, resulting in no pulsed current through the second transmitter 29 (Q311). In other words, detection of signal contact by safety switch 39 disables transmission of the second pulsed wireless signal.

When Q307 is biased to conduct, the collector output voltage at 43 is held low during the presence of the pulse. With output 43 at low, current flow through resistors R316 and R317 turns on Q312, which causes Q313 to be turned on, resulting in illumination of the green indicating light 27. Illumination of light 27 indicates to hospital personnel that path 23 is not blocked. Though Q313 actually switches off and on due to reception of pulsed signals, the pulses are received with sufficient frequency that the coupling diode (IN4148) and 0.33 $\mu$F integrating capacitor across resistors R316 and R317, result in light 27 being continuously illuminated.

When the first wireless signal is not received at (25) Q301, or after the trailing edge of the last pulse, Q307 is no longer forward biased at the base and output at 43 goes high. This interrupts charge storage in the integrating capacitor and resistors R316 and R317 quickly dissipate the remaining charge, switching Q312 off and causing Q313 to turn off, thereby interrupting current through light 27. Simultaneously, Q314 and Q315 become forwardly biased and their combined current flows through and illuminates the red warning light 28 to indicate that the first wireless signal is not being received.

A five volt power source 45 mounted in or adjacent to the light 11 supplies electrical power to the safety switch 39 and the control system 21 circuitry mounted at the safety light 11.

Figure 4:
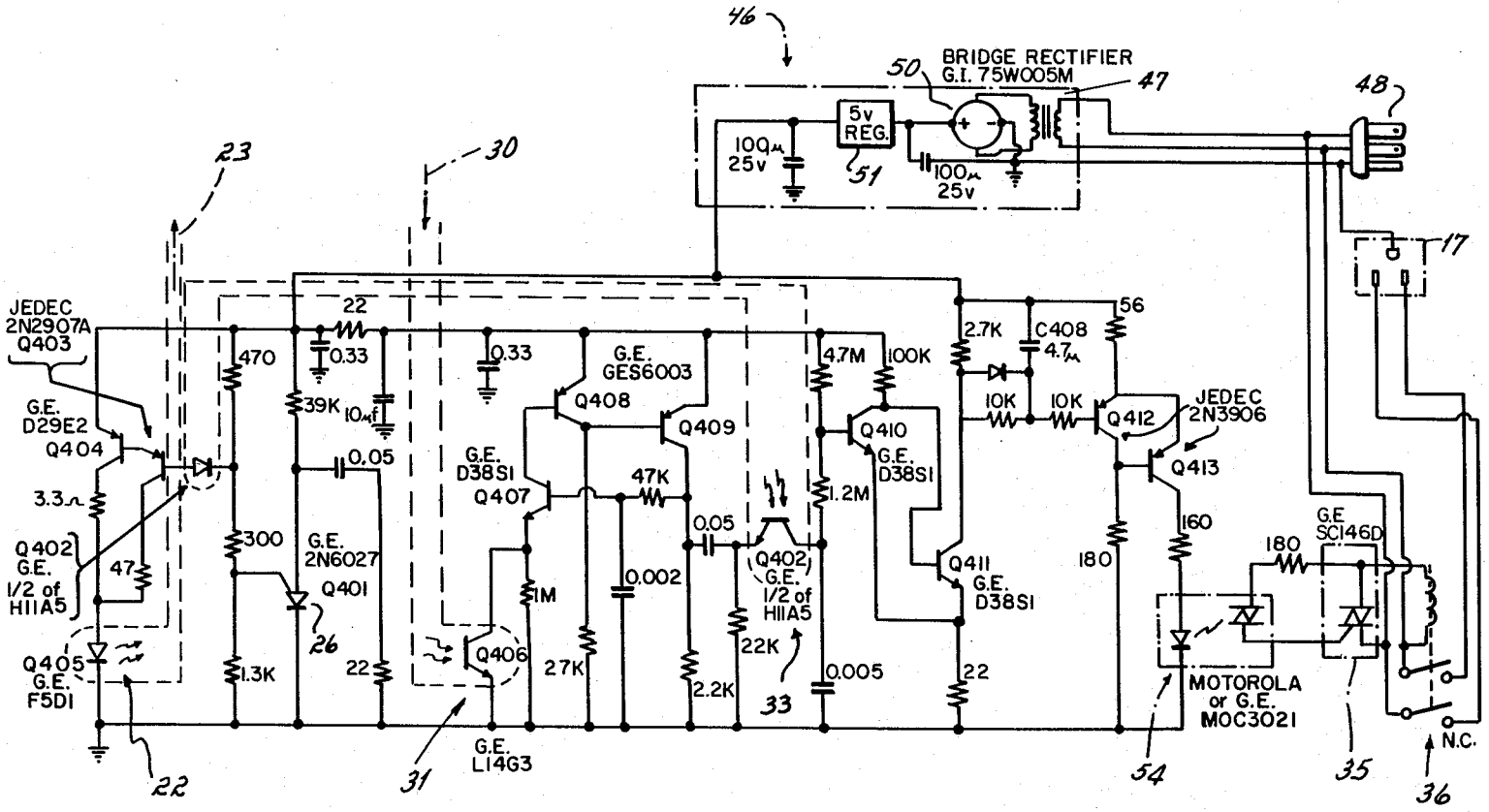
FIG. 4 is a circuit diagram of a preferred embodiment of the bumper mounted circuit of the safety control system of this invention.

FIG. 4 is a schematic showing a preferred embodiment of the circuit components and their interconnections which are mounted at the outlet 17. A five volt power supply designated generally as 46 provides electrical energy necessary to drive these components. The supply voltage may be provided by a step down transformer 47 electromagnetically coupled to a conventional household power source 48, a rectifier 50 and a voltage regulator 51.

With the power supply 46 connected, current flows through oscillator 26, shown in FIG. 4, as Q401. Oscillator 26 (Q401) is a synchronous pulse oscillator commercially available from General Electric, catalog No. G.E. 2N6027, which provides a clock for the control system 21. The pulse width is approximately 10 microseconds, with pulses occurring about every 2 milliseconds. Driven by transistors Q403 and Q404, the first transmitter 22 (Q405) transmits the first wireless signal toward the safety light 11, along path 23. First transmitter 22 (Q405) is an infrared transmitting diode commercially available under General Electric catalog No. G.E.F5D1 and shown as Q405 in FIG. 4. The pulses from clock Q401 key component Q402 which is connected to the base of Q403, thus pulsing off and on the current through transistors Q403 and Q404 which supply Q405, (the first transmitter 22). Q402 is provided by one half of a component which is commercially available from General Electric, catalog No. H11A5.

The second infrared receiver 31, shown in FIG. 4 as Q406, receives the second pulsed infrared signal traveling from the light 11 along route 30. The receiver 31 (Q406) is an infrared sensitive transistor commercially available as General Electric catalog G.E.L14G3. An amplifier 32, comprising transistors Q407 through Q409 and the associated resistors and capacitors, provides noise immune infrared amplification of the signal received at Q406 (31), resulting in a signal at the output of Q409 which has a unity gain with respect to ambient noise. The output of Q409 is fed into synchronous gate 33, which is closed during the transmission of a pulse by Q405, to synchronously detect return pulse signals via the second IR transmission along route 30. Synchronous gate 33 is shown in FIG. 4 as Q402, an optically coupled transistor commercially available from General Electric, Catalog No. G.E.H11A5. The gate 33 looks for reception of the second pulse only during the time when the first pulse is being transmitted. Use of synchronized pulses precludes the introduction of spectral noise into the control system 21 between pulses.

Reception of a pulse at the input of Q410 drives its input negative, holding Q410 off. This allows Q411 to be in a conductive state. With Q411 on, Q412 is turned on, holding Q413 off. With Q413 off, the optically coupled triac 54 remains off, and a relay driver 35 remains in an off condition. The optically coupled triac 54 is commercially available from Motorola or General Electric, Catalog No. MOC3021 or GE3021, respectively. The relay driver 35 is commercially available from General Electric, Catalog No. G.E. SC146D. The 0.005 μF capacitor at the synchronous detector 33 (Q402) output holds Q410 in an off condition between pulses.

When Q410 eventually turns on, after failure to receive a pulse at receiver 31 (Q406), and after dissipation of voltage held by the detector capacitor, Q410 turns on, Q411 and Q412 turn off, and Q413 turns on. With Q413 on, current through the optically coupled triac 54 activates the relay driver 35 to open the normally closed relay 36, thus disconnecting power from the source supply 48 to the outlet 17 serving the bed.

In accordance with a preferred embodiment of this invention, to further reduce the effects of ambient noise, the receivers 25, 31 (as seen schematically in FIG. 2) are aimed at their respective transmitters 22 (Q405) and 29 (Q311) and recessed within a black tube 58 with Schott glass 59 serving as a filter to reduce the input spectrum.

It should be obvious to those skilled in the art that other techniques may be employed to establish the wireless link, such as pulse-coded I-R, visible light, laser, ultrasonics, sound waves, or other. It should also be obvious that the ultimate control function need not be total power shut down but only shut down of vertical raising of the bed. The shutoff could simply be an inhibiting of the bed-UP operation, which is most likely to cause interference with the safety light via an I.V. pole or other attachment.

In one alternate embodiment of the invention, an audio oscillator in the safety light sounds an alarm when contact occurs. This alarm is frequency shift coded at a precise rate . . . 10 KHz and 4 KHz, in alternating 1 msec bursts, for illustration. These frequencies are chosen because they are well beyond the peak distribution in normal conversational voice. A microphone in the bed picks up this signal, bandfilters and amplifies it, possibly with AGC to prevent clipping and harmonic generation, and then processes the received audio in two band-pass filters centered at 4 KHz and 10 KHz, of low order and 10% bandwidth to reduce time delay. Outputs are detected and fed into Schmitt triggers.

One channel, the 10 KHz for example, is inverted so that both outputs will be in phase, and the phase-coherent signals are fed into a Schmitt AND gate, the output of which will toggle at the frequency shift rate, 500 Hz herein. Another bandpass filter checks for this frequency component, and if present, the detector supplies a signal which either (a) simply stops the bed UP function, or (b) stops bed UP and runs bed DOWN for ½ to 1 second to eliminate the interference.

The probability of inadvertent activation by voice or music is virtually nil since the detector looks for two specific frequencies, 4 KHz and 10 KHz, alternately presented at a 500 Hz rate. Use of an audio signal would circumvent the need to use the two-way wireless signal.

While the above description constitutes a preferred embodiment of the safety control system 21 of this invention, and one alternative embodiment of the invention it is to be understood that the invention is not limited thereby and that in light of the present disclosure of the invention, various other alternative embodiments will be apparent to a person skilled in the art. Accordingly, it is to be understood that changes may be made without departing the scope of the invention as particularly set out and claimed.

We claim:

1. In a hospital room safety control system for disconnecting electrical power to an electrically operated bed to interrupt vertical movement of the bed upon contact between a bed mounted structure and a safety light mounted to a head wall, said electrical power being supplied to said bed via an outlet below the light, the improvement comprising:
   - a first transmitter adjacent the outlet and adapted to transmit a first wireless signal to said safety light;
   - a first receiver mounted at said safety light adapted to receive said first wireless signal;
   - a second transmitter at said safety light operatively associated with said first receiver and adapted to transmit a second wireless signal upon reception of said first wireless signal;
   - a second receiver adjacent said outlet and adapted to receive said second wireless signal;
   - a power control circuit operatively associated with said second receiver and adapted to supply electrical power to said outlet upon reception of said second wireless signal;
   - a safety switch at said safety light adapted to detect contact with said light, said safety switch being operatively associated with said second transmitter to disable transmission of said second wireless signal upon detection of said contact, thereby to disconnect electrical power to said outlet when said light is contacted.

2. A safety control system as in claim 1 and further comprising:
   - a bumper mounted to said head wall adjacent the floor of the hospital room, said outlet mounted to said bumper and said first transmitter, said second receiver and said power control circuit being located adjacent said outlet.

3. A safety control system as in claim 1 and further comprising:
   - a second safety switch, the switches mounted at horizontally spaced opposite ends of said light, thereby to provide increased sensitivity in detecting contact with said light.

4. A safety control system as in claim 1 and further comprising:
   - an indicator mounted at said safety light and operatively associated with said first receiver, said indicator adapted to indicate reception of said first wireless signal.

5. A safety control system as in claim 4 wherein said indicator further comprises:

a first colored light illuminated upon reception of said first wireless signal; and a second colored light illuminated upon absence of reception of said first wireless signal, said first and second colors being different.

6. A safety control system as in claim 5 wherein said first color is green and said second color is red.

7. A safety control system as in claim 4 wherein said indicator is an audible alarm.

8. A safety control system as in claim 1 wherein said first and second wireless signals are infrared signals.

9. A safety control system as in claim 1 wherein said first and second wireless signals are pulsed infrared signals.

10. A safety control system as in claim 1 wherein reception of said second wireless signal is synchronized with transmission of said first wireless signal.

11. A method of disconnecting electrical power to an electrically operated bed upon contact between a bed mounted structure and a safety light, the electrical power being supplied to the bed via an outlet below the light, comprising the steps of:

transmitting an upwardly directed wireless signal to said safety light from a first transmitter mounted adjacent said outlet to a first receiver mounted at said light;.

transmitting a downwardly directed wireless signal from a second transmitter mounted at said safety light to a second receiver mounted adjacent said outlet upon reception of said first wireless signal by said first receiver, said second transmitter being operatively associated with said first receiver, said second receiver being operatively associated with a relay;

providing electrical power to said outlet via said relay upon reception of said second wireless signal;

detecting the occurrence of physical contact with said safety light by a switch mounted at said light, said switch operatively associated with said second transmitter; and disabling transmission of said second wireless signal when said physical contact is detected, thereby interrupting electrical power to said outlet at said relay.

12. A method as in claim 4 and further comprising the step of:

indicating reception of said upwardly directed wireless signal with an indicator located at said safety light, said indicator operatively associated with said first receiver.

* * * * *

UNITED STATES PATENT AND TRADEMARK OFFICE

CERTIFICATE OF CORRECTION

PATENT NO. : 4,882,566

DATED : November 21, 1989

INVENTOR(S) : Koerber, Sr. et al.

It is certified that error appears in the above-identified patent and that said Letters Patent is hereby corrected as shown below:

In Claim 12:

Column 10, line 21, "4" should be --11--.

Signed and Sealed this

Thirteenth Day of November, 1990

*Attest:*

HARRY F. MANBECK, JR.

*Attesting Officer*

*Commissioner of Patents and Trademarks*